United States Patent [19]

Kie

[11] Patent Number: 4,581,776

[45] Date of Patent: Apr. 15, 1986

[54] MOTORCYCLE HELMET

[76] Inventor: Harold Kie, 4152 Elm St., Long Beach, Calif. 90815

[21] Appl. No.: 759,460

[22] Filed: Jul. 26, 1985

[51] Int. Cl.[4] ..... A42B 3/00

[52] U.S. Cl. ..... 2/425; 2/413; 2/427

[58] Field of Search ..... 2/425, 411, 413, 427

[56] References Cited

U.S. PATENT DOCUMENTS 3,593,338 7/1971 Penny ..... 2/427

4,446,576 5/1984 Hisataka ..... 2/425

*Primary Examiner*—Louis K. Rimrodt

*Attorney, Agent, or Firm*—Charles H. Thomas

[57] ABSTRACT

A motorcycle helmet is provided which has a sliding visor that moves on tracks on opposite sides of the eye area of a wearer's face. The visor slides relative to a casing which envelopes the back, side and crown of a wearer's head to selectively expose and shield the wearer's eyes. A chin guard is hinged to one side of the casing and a latch mechanism with a release actuator is located on the opposite side. An inflatable bladder, located within the chin guard, serves as a cushion and can be inflated by the user once the jaw guard is latched. Operation of the release actuator to unlatch the jaw guard causes the bladder to deflate.

13 Claims, 13 Drawing Figures

FIG. 1
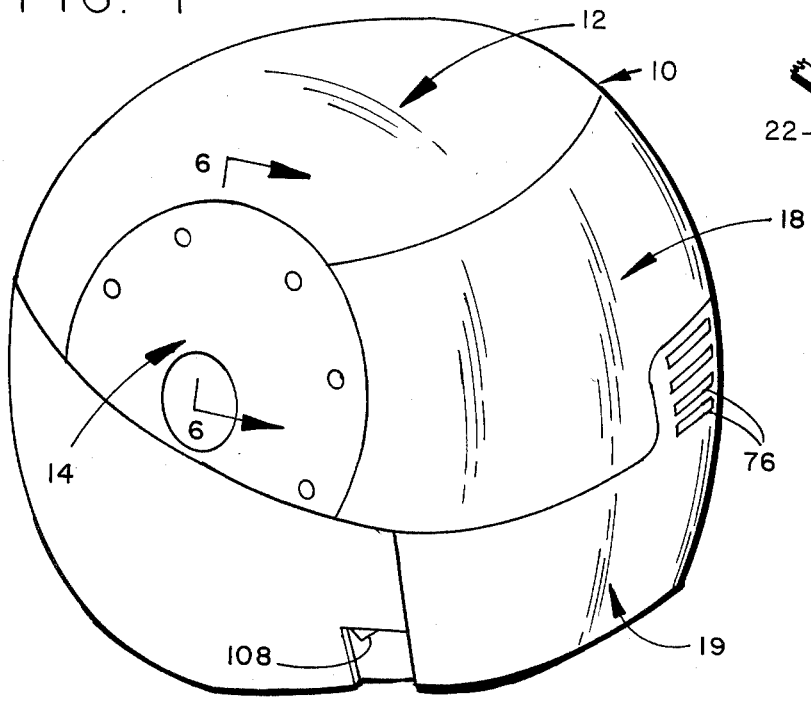
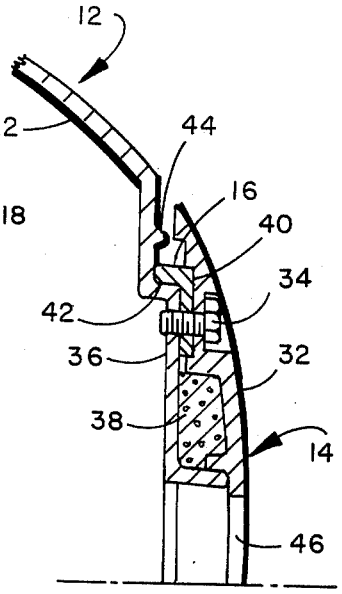
FIG. 6
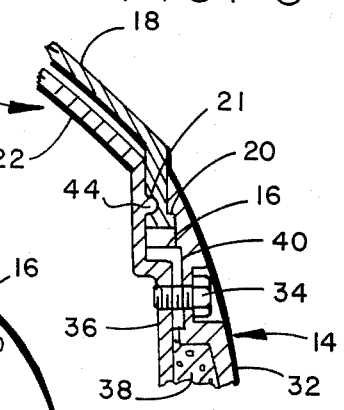
FIG. 6A
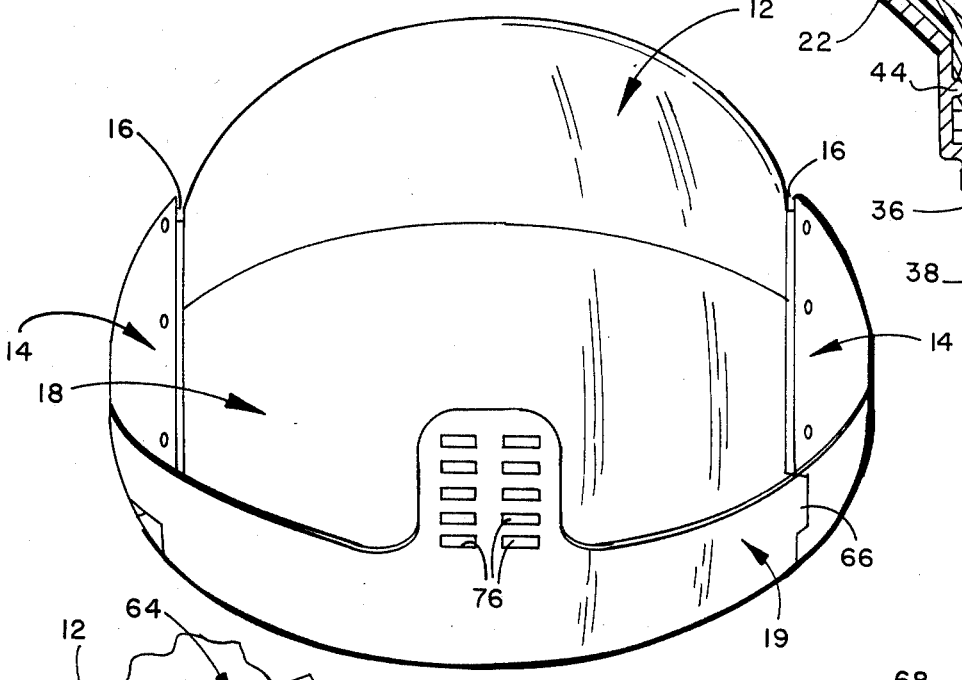
FIG. 5
FIG. 8
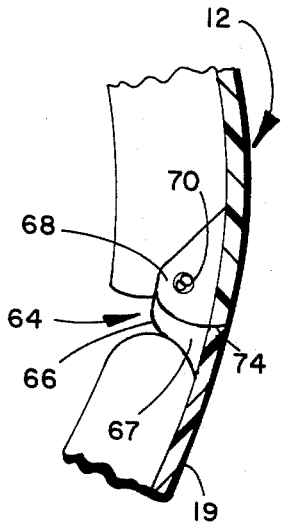
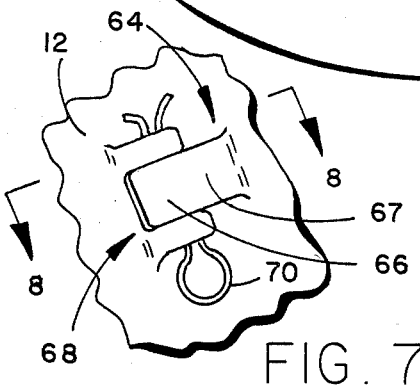
FIG. 7

FIG. 2
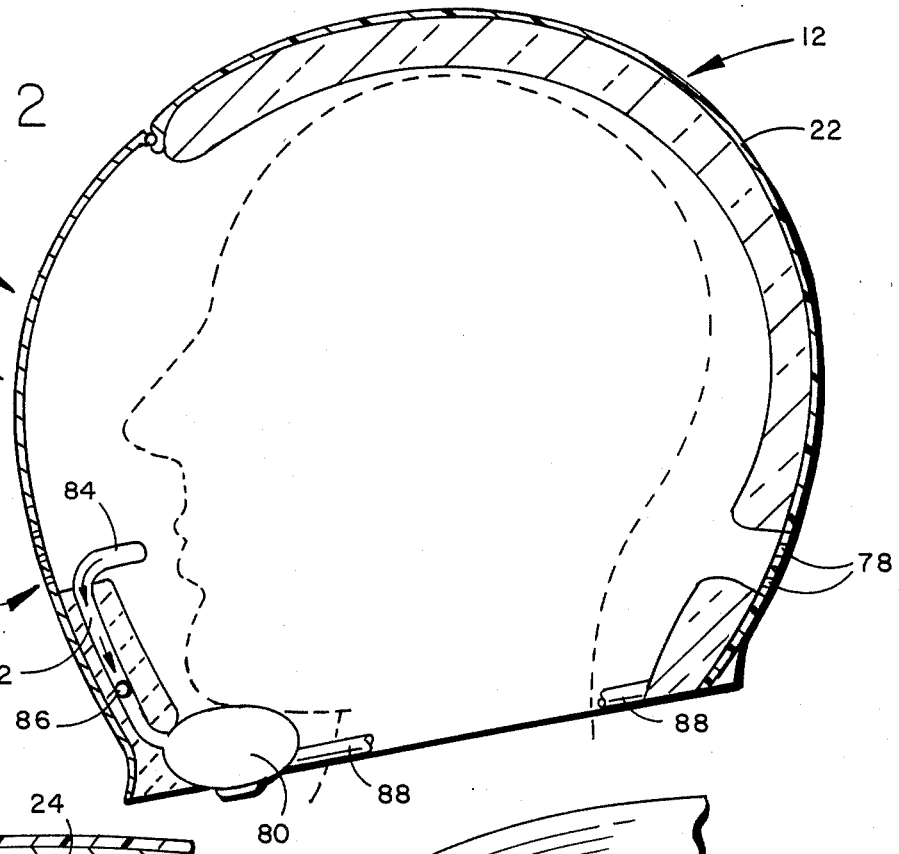
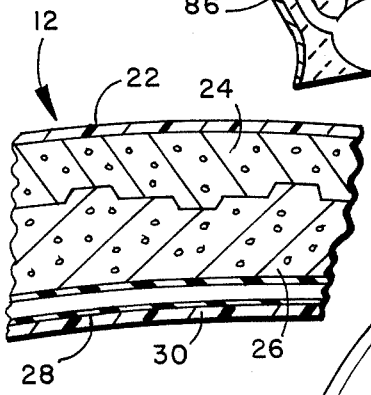
FIG. 12
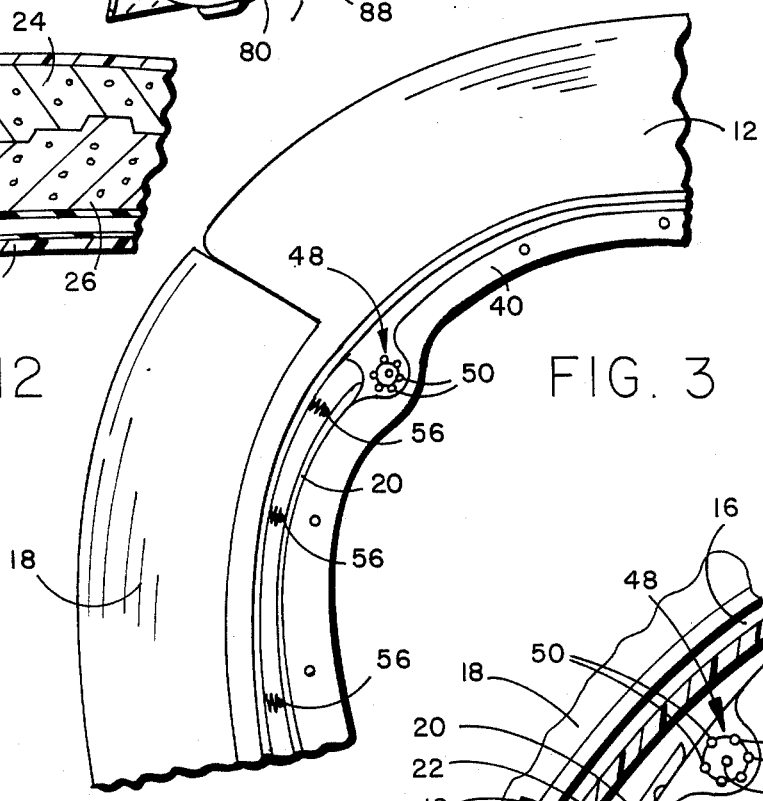
FIG. 3
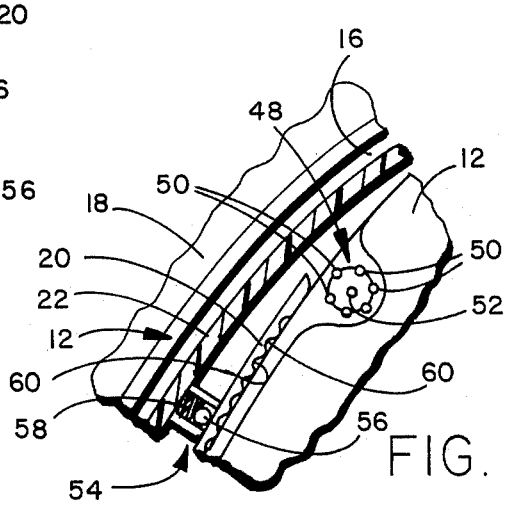
FIG. 4

MOTORCYCLE HELMET

BACKGROUND OF THE INVENTION

1. Field of the Invention

The present invention relates to motorcycle helmets.

2. Description of the Prior Art

In the past, various motorcycle helmets have been provided for wear by cyclists to prevent or minimize the seriousness of head injuries which may be inflected upon the cyclists. Conventional motorcycle helmets employ a hard casing which envelopes the back, sides and crown of the wearer's head and which leaves the wearer's eyes, nose and mouth exposed. A chin strap is typically permanently secured to one side of the casing and passes beneath the chin of the wearer. The chin strap is frequently releasably secured at its opposite end to the other side of the casing by means of a snap fastener or buckle.

SUMMARY OF THE INVENTION

The present invention is an improvement to a protective cycle helmet having a hard casing which envelopes the back, crown and sides of a wearer's head and which has resilient padding therewithin. According to the improvement of the invention, tracks are defined within the structure of the casing. A sliding visor is reciprocally moveable along the tracks to selectively expose and shield the eye area of a wearer. A chin guard is hingedly attached to the casing on one side of the jaw area of the wearer. A latch mechanism is provided to releasably secure the chin guard in position extending across and protecting the jaw of a wearer. A manually actuable release actuator is provided for disengaging the latch mechanism to allow the helmet to be removed.

The latch mechanism is constructed so as not to protrude outwardly from the surface of the chin guard or the casing. Rather, the latch mechanism is contained entirely within the structures of the chin guard and casing except for the appearance of a small portion of the release actuator. The release actuator does not protrude outwardly, but rather is mounted in the undersurface of the lower edge of a part of the casing which extends forwardly to meet the chin guard and to house portions of the latch mechanism.

The chin guard itself swings on a hinge relative to the casing and may be shut so as to entirely cover and protect the wearer's chin and jaw, or, alternatively, to swing away so that the wearer can remove the helmet from his head. Preferably, the hinge is located entirely internal to the helmet so that the junction between the chin guard and the casing is entirely smooth. The hinge will thus offer no wind resistance. The hinge is constructed with a short arm which carries the chin guard so that the chin guard can be swung out away from the casing without interference from the structure of the casing.

The sliding visor provides protection for the wearer's eyes and nose during use. The visor is, of course, transparent, and preferably is tinted as well. The visor slides in an arcuate path upwardly and is cammed outwardly to move in spaced separation from the surface of the helmet casing in the forehead area thereof. The opposite edges of the visor are entrapped in tracks and are reciprocally moveable in tandem within those tracks. As the visor is pushed upwardly toward the forehead area of the helmet casing, a cam mechanism carries the visor outwardly away from the helmet casing so that the visor does not scrape against the forehead area of the helmet casing.

The visor may preferably be moved to three detented positions. In the uppermost position the visor exposes the eyes and nose of the wearer's face to provide the wearer with unobstructed vision and to provide fresh air without totally removing the helmet. The visor may be moved in an arcuate path downwardly to shield the eyes of the wearer, but to leave the nose area open. From this second detent position the visor may be rotated further downwardly shut against the chin guard to completely protect the eyes and nose area of the wearer.

A biasing means urges the visor inwardly so that once the visor clears the cam mechanism located at the rim of the face opening near the forehead area of the helmet casing, the biasing means pushes the visor a short distance inwardly to seat snugly in the eye and nose opening of the helmet casing. The visor is located sufficiently distant from the wearer's nose so that fogging of the transparent visor does not become a problem. In the closed position the visor completely shields the eye and nose area of the human face.

The helmet casing is equipped with removeable, spherical segment-shaped ear guards on the laterally opposite sides of the helmet casing. The track mechanisms for the helmet visor are located at the interfaces between the ear guards and the helmet casing. By constructing the helmet with removeable ear guards, the tracks can be internally located within the structure of the helmet, thus providing the helmet with a smooth, aerodynamically stable, hard outer surface. The overall configuration of the helmet casing and ear guards is nearly spherical with an open segment at the neck area of the wearer. By employing a helmet of generally spherical shape, the wearer can turn his or her head from side to side without receiving a twisting effect from wind force. The ear segments include transaxial aligned central apertures therethrough. Internal cushioning within the ear segments muffles wind noise but allows for the penetration of sound through the central axial apertures. The wearer is thus able to easily hear horns, sirens and so forth.

The interior of the casing includes multiple layers of foam padding to protect the wearer from head injury in the event of an impact. The helmet includes a considerable amount of padding on the inside of the helmet casing in the area of the wearer's temples and checkbones. Massive padding is provided within the helmet casing to cushion the back of the wearer's head and the rear area of the neck. Separate areas of padding cushion the forehead, the crown of the head and the sides of the back of the head.

One particularly unique feature of the helmet of the invention is the provision of inflatable cushioning in the hinged chin guard beneath the wearer's chin. The chin guard is provided with an inflatable plastic bladder which includes a small, upstanding tube, hooked at the top so that the wearer can seize it in his or her mouth. A one-way check valve in the filling tube allows the wearer to inflate the bladder so that it snugly, but comfortably cushions the wearer's chin.

A vent line extends from the inflatable chin cushion bladder around the interior of the helmet casing from the hinge area on one side, around the back of the helmet casing, to the latch area for the chin guard on the opposite side of the helmet casing. The vent line terminates in a mouth which is held in a fixed orientation directed forwardly toward the chin guard latch. The vent line mouth is adapted to receive a sealing plug which is mounted in the helmet casing for reciprocal movement toward and away from the chin guard latch. The structure of the chin guard itself includes a tongue having a broad tip and a notch or detent recess therebehind. The tongue projects longitudinally from the chin guard and the tip of the tongue is wedge-shaped, generally in the form of an arrowhead. A lever mechanism is mounted in the helmet casing and includes a pair of pawls or catches which are moveable transversely relative to the longitudinal orientation of the tongue, generally at right angles thereto. The pawls or catches move between engaged and disengaged positions relative to the detent recesses behind the tip of the chin guard tongue. A pair of intermediate arms which have first and second ends and fulcrums located between the ends move the pawls in transverse, reciprocal fashion relative to the tongue. The first ends of the intermediate arms are rotatably coupled to the pawls by hinges. The second ends of the intermediate arms are rotatably connected to transversely oriented links, which in turn are connected end-to-end to each other by a pivot rod. The pivot rod is biased by a coil spring to push upon the intermediate arms and urge the pawls toward their engaged positions. The lowermost of the intermediate arms is configured with downwardly facing surfaces converging at an obtuse angle to form a rocker, which serves as the releasable actuator for the chin guard latch mechanism. The transverse links are directed toward each other and are rotatably connected together where they are joined together by a hinge connector which also couples the links to the reciprocal plug element. The forwardly facing end of the plug element has an angled recess therein configured to receive the point of the arrowhead-shaped tip of the chin guard tongue.

When the chin guard is closed the structure of the chin guard swings in gate-like fashion about the hinge connection on one side. The tongue of the chin guard is oriented in longitudinal alignment to meet the concave recess in the end of the vent line plug. As the tongue pushes rearwardly against the vent line plug, the plug seals the mouth of the vent line and at the same time brings the pair of interconnected transversely oriented links into nearly linear alignment. The movement of the links in turn rotates the intermediate arms in opposite directions, thereby driving the catches or pawls into the transversely oriented detent recesses on the opposite sides of the tip of the tongue. The pawls remain latched in this condition, thereby securely holding the chin guard in position on the head of the wearer, so that the helmet remains secure upon the wearer's head.

To release the chin guard, the release actuator formed by the rocker is opressed. This folds the connected links forwardly from their initial nearly linear alignment against the bias of the coil spring located in the reciprocal plug element to orientate the links at a significant angle relative to each other. This movement rotates the pawls or catches out of engagement with the detent recesses and simultaneously withdraws the plug from the vent line mouth. The bladder forming the chin cushion is thus deflated as the chin guard is unlatched.

The invention may be described with greater clarity and particularity by reference to the accompanying drawings.

DESCRIPTION OF THE DRAWINGS

FIG. 1 is a perspective view of a helmet according to the invention.

FIG. 2 is a side sectional elevational view of the helmet of FIG. 1.

FIG. 3 is an elevational view from the left side of the helmet with the left ear segment removed.

FIG. 4 is an elevational detail indicated at 4 in FIG. 3.

FIG. 5 is a front elevational view of the helmet of FIG. 1.

FIG. 6 is a sectional detail taken along the lines 6—6 of FIG. 1.

FIG. 6A shows the visor engaged in the track of FIG. 6.

FIG. 7 is a side elevational detail of the chin guard hinge from inside the helmet.

FIG. 8 is a sectional detail of the chin guard hinge taken along the lines 8—8 of FIG. 7.

FIG. 12 is a sectional detail showing the helmet padding.

DESCRIPTION OF THE EMBODIMENT

Figure 10:
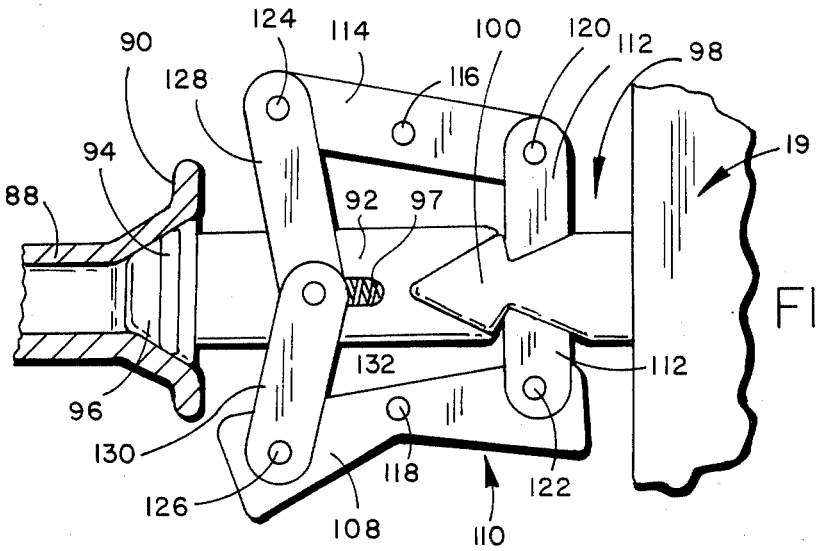
FIG. 10 is an elevational view illustrating the operative components of the latching mechanism in the latched position.

FIG. 1 illustrates a protective motorcycle helmet 10 having a generally spherical configuration. The helmet 10 has a curved, hard casing 12 shaped to conform to the back, crown and sides of a human head. A pair of ear protecting sections 14, shaped as spherical segments are located on opposite sides of the casing 12 and a pair of parallel, arcuate tracks 16 are defined at the interfaces of the ear protecting segments 14 and the casing 12 and are depicted in detail in cross section in FIG. 6. The tracks 16 are positioned to reside on opposite sides of the eye area of the human face, as illstrated in FIG. 5. A sliding, plastic, transparent visor 18 is provided and has opposite edges 20 entrapped in the tracks 16, as depicted in detail in FIG. 6A. The edges 20 of the visor 18 are reciprocally moveable in tandem within the tracks 16 so that the visor 18 slides in an arcuate path from the closed positon, depicted in FIGS. 1, 2, 3 and 5 for shielding the eye area of a human face, to an open position adjacent to the forehead portion of the casing 12 to expose the eye area of a human face therebehind.

FIG. 12 illustrates a cross section of the helmet casing 12. The casing 12 includes a hard, outer shell 22 formed of polycarbonate plastic or kevlar, which is a carbon composite. The first layer of padding 24 beneath the shell 22 is formed of a soft pad of styrofoam approximately one-half inch in thickness. The inner surface of the styrofoam pad 24 has a crenelated, interlocking construction with an interiorally located pad 26 of semi-rigid styrofoam, approximately one inch in thickness. A permanently sealed pneumatic bladder 28 forms a further cushion approximately one-quarter inch in thickness interiorally of the semi-rigid styrofoam pad 26. The innermost layer 30 of padding is formed of cloth or foam approximately one-eighth inch in thickness. The minimum thickness of the structure of the helmet casing 12 is about one and one-quarter inches, and the maximum thickness of the shell and all layers of padding is about two and one-quarter inches.

FIG. 6 illustrates the structure of an ear protecting segment 14. Each ear protecting segment 14 is formed of a spherical segmental shaped outer shell 32 which is fastened by nylon machine screws 34 to flat portions 36 of the shell 22 of the helmet casing 12. An annular ring of polyurethane foam 38 is entrapped between the ear protector shell 32 and the flattened portion 36 of the helmet casing shell 22.

An arcuate steel ring 40 of angle-shaped cross sectional configuration is interposed between the ear protector shell 32 and the helmet casing shell 22 and forms the floor of the track 16. The arcuate rings 40 are bonded by cement to the outer surface of the helmet shell 22 and are tapped to receive the threaded nylon screws 34. The screws 34 hold the ear protecting segments 14 in position to define the track 16. Compressible protuberances 44 project laterally from the flattened portion 36 of the helmet casing into the L-shaped track 16 defined between the helmet and ear protective shells 22 and 32, respectively, to coact with corresponding detents 21 in the L-shaped edges 20 of the visor 18, as depicted in FIG. 6 and 6A. When the visor 18 is moved arcuately upwardly or downwardly relative to the helmet casing 12, the protuberances 44 will tend to hold the visor 18 at the three detent positions defined by sets of arcuately spaced detents 21. The force with which the protuberances holds the visor 18 is quite light, so that the visor 18 can be moved easily in its arcuate path from one detent position to the next.

Open apertures 46 are defined in the ear protecting segments 14 so that the wearer of the helmet 10 is able to clearly hear sounds such as sirens and horns. Nevertheless, the polyurethane foam padding 38 tends to muffle wind noise.

FIGS. 3 and 4 illustrate a cam mechanism 48 which serves to deflect the visor 18 outwardly away from the casing 12 as the visor 18 rotates relative to the casing 12 to expose or shield the eye area of a human face therebehind. The cam mechanism 48 is formed of a wheel bearing a plurality of entrapped nylon spheres 50. The wheel rotates about an axle 52 which is entrapped between the helmet casing shell 22 and the ear protector shell 32.

A biasing mechanism 54 in the form of spring loaded nylon spheres 56 is provided to bias the visor 18 radially inwardly toward the casing 12 when the visor 18 is in the closed position depicted in FIGS. 1, 2 and 5. The spheres 56 act upon the laterally extending flanges of the visor edges 20 to bias the visor 18 radially inwardly toward the casing 12. The spheres 56 are biased by means of coil springs 58. The spring 58 causes the sphere 56 to urge the visor 18 into a configuration flush with the shape of the helmet casing 12 when the visor 18 is closed, as depicted in FIGS. 2 and 3.

When the visor 18 is rotated upwardly and to the right, as viewed in FIGS. 2 through 4, the cam mechanism 48 will rotate so that the nylon spheres 50 thereon push the edges 20 of the visor 18 radially outwardly from the helmet casing 12 to the position depicted in FIG. 6A. FIG. 6A is a cross sectional detail showing the disposition of the visor edges 20 in a track 16 when the visor 18 is totally or partially open. The deflecting action of the cam mechanism 48 carriies the visor 18 radially outwardly from the outer surface of the helmet casing shell 22, so that the visor 18 does not scratch the surface thereof. The center of rotational movement of the visor 18 is therefore located forwardly and upwardly from the center of the spherical surface of the helmet casing 12, as viewed in FIGS. 2 through 4.

When the visor is pushed in the opposite direction, downwardly and to the left as viewed in FIGS. 2 through 4, it will ultimately clear the cam mechanism 48, as depicted in FIG. 4. Once the visor 18 clears the cam mechanism 48, the springs 58 act through the nylon spheres 56 to bias the visor 18 so that it is flush with the outer surface of the shell 22 of the helmet casing 12. The interior surface of the edges 20 of the visor 12 are formed with arcuate recesses 60 which sequentially receive the nylon spheres 50 as the visor 18 moves past the cam mechanism 48. The nylon spheres 50 act upon the undersurfaces of the edges 20 at the depressions 60 to force the visor 18 outwardly and beyond the surface of the helmet casing 12.

The helmet 10 is provided with a chin guard which is attached to the helmet casing 12 by a hinge indicated at 64 in FIGS. 7 and 8. The hinge 64 is formed by a single central knuckle 66 carried by a short arm 67 on the hinge extremity of the chin guard 19 and by corresponding knuckles formed by a yoke 68 on the helmet casing 12. The hinge axle is formed by a removeable pin with a quick release pull ring 70. In an emergency the wearer can reach up inside the helmet and pull the ring 70 so that the chin guard 19 will fall away and the wearer's head will not be entrapped in the helmet. The helmet can be removed immediately should burning gasoline be thrown into the helmet through the face opening. In an accident the latch mechanism can become jammed or the wearer might have difficulty in manipulating the release actuator for the chin guard. The arm 67 is just long enough so that the chin guard 19 will clear the casing 12 as the chin guard 19 is swung open. When the chin guard 19 is closed, the junction between the chin guard 19 and the helmet casing 12 presents a smooth outer surface to minimize wind risistance. Only a hairline demarkation is visible at the interface 74.

At the front of the chin guard 19 there are air circulation inlet slots 76 to allow the wearer to obtain fresh air. As illustrated in FIG. 2, the air slots 76 are oriented at an angle to prevent rushing air from blowing directly into the wearer's face. Air is channeled to air outlet slots 78 at the base of the rear of the helmet casing 12. A balanced flow of fresh air circulation is threby provided through the helmet 10.

As illustrated in FIG. 2, the chin guard 19 is provided with resilient foam padding of the type depicted in FIG. 12. However, at the base of the center of the chin guard 19 an inflatable bladder 80 is provided which serves as a chin cushion when inflated. An upstanding plastic tube 82 is immobilized within the foam padding and terminates at a radially inwardly extremity 84. The wearer is able to seize the extremity 84 of the filling tube 82 so as to inflate the bladder 80. A check valve, indicated at 86, allows air to pass into the bladder 80, as indicated, but prevents compressed air from venting from the bladder through the tube 82.

Figure 11:
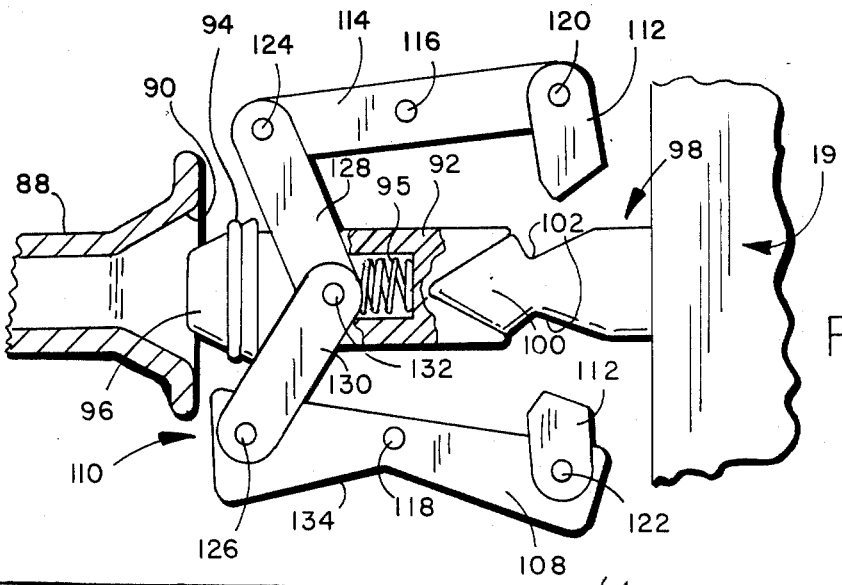
FIG. 11 is an elevational detail illustrating the operative components of the latching mechanism in the released condition.

A vent line 88 extends around the base of the helmet casing 12 on the hinged side of the chin guard 19 and terminates on the opposite side in a vent line mouth 90, depicted in FIGS. 10 and 11. The vent line mouth 90 is located in the path of movement of a latch actuating slug 92. The latch actuating slug 92 has a rearwardly directed extremity 96 with an annular rubber O-ring 94 mounted thereon so that the rear end 96 of the latching actuating slug 92 forms a plug for sealing the vent line mouth 90. The latch actuating slug 92 has a longitudinally oriented cavity therewithin in which a compressible coil spring 95 is located. A portion of the wall of the latch actuating slug 92 is broken away in FIG. 11 for purposes of illustrating the spring 95. The spring 95 is compressed between the forward end of the cavity in the latch actuating slug 92 and a pivot pin 132, which rides within a longitudinal slot 97 visible in FIG. 10, in the wall of the slug 92. The slot 97 limits longitudinal movement of the pivot pin 132 in both directions.

The chin guard 19 is equipped with a rearwardly extending tongue 98 having a broad tip 100 shaped generally in the form of an arrowhead. The tongue 98 is necked down behind the tongue tip 100 to form detent recesses 102 on both of the transversely opposite sides thereof. The detent recesses 102 form catches behind the tip 100. The rearwardly extending surfaces of the tip 100 form an acute angle and are wedge-shaped so as to mate in a corresponding, forwardly facing recess in the forward extremity of the latch actuating slug 92.

Figure 9:
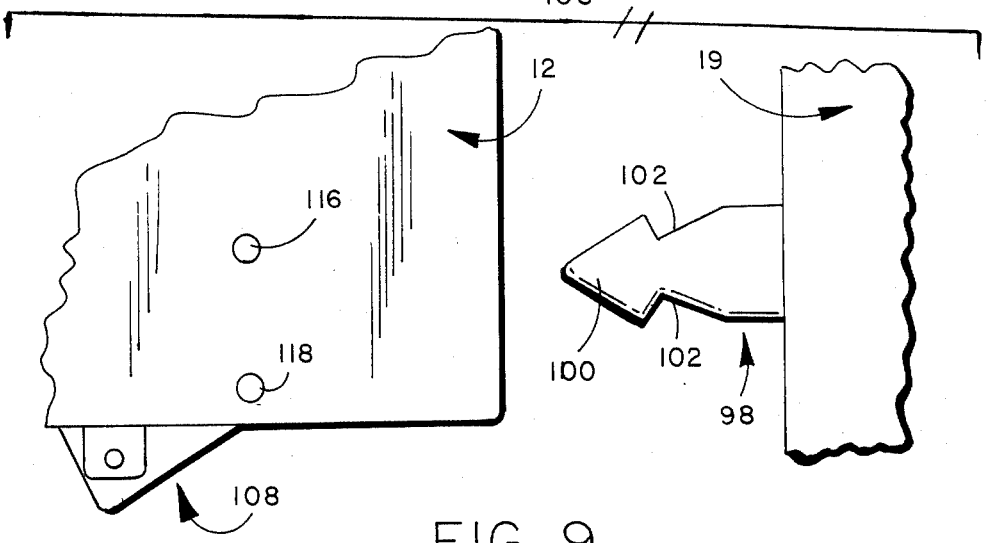
FIG. 9 is an elevational detail showing the chin guard latch and release actuator mechanisms from the exterior of the helmet.

The chin guard latching mechanism includes a manually actuable release actuator 108, visible externally of the helet 10 in FIGS. 1 and 9. As illustrated in FIG. 1, the release actuator 108 is recessed from the outer surface of the chin guard 19 and the casing 12 so that it cannot be accidently actuated by snagging on some object, such as clothing. The release actuator 108 is a downwardly facing rocker projecting from the underside of a forwardly directed portion of the casing 12 in which a number of the operating components of the latch mechanism are carried.

The operating components of the chin guard latch mechanism are indicated generally at 110 in FIGS. 10 and 11. The latch mechanism 110 includes a pair of pawls or catches 112 directed toward each other and toward the tongue 98 located therebetween from opposite sides. The pawls 112 are constrained to move in a transverse direction by guiding structure, not depicted for the sake of clarity, within the helmet casing 12. The pawls 112 are operable by means of the release actuator 108 to move from the engaged position of FIG. 10 to the disengaged position of FIG. 11. The latch mechanism 110 includes a lever system which employs an upper intermediate arm 114 and a lower intermediate arm formed by the release actuator 108. The intermediate arms 114 and 108 are levers which are rotatable in see-saw fashion about fulcrums formed by studs 116 and 118, respectively, on the helmet casing 12.

The intermediate arms 114 and 108 both have first ends which are rotatably coupled by means of pins 120 and 122 respectively, to the catches formed by the pawls 112. The second ends of the intermediate arms 114 and 108 are rotatably connected by pins 124 and 126, respectively, to links 128 and 130, which in turn are rotatably connected by the pivot pin 132. The coil spring 95 bears against the pivot pin 132 and normally urges it to the left to bring the links 128 and 130 to nearly linear alignment, as depicted in FIG. 10.

When the chin guard 19 is swung open, the operating components of the latch mechanism 110 are forced to the positions depicted in FIG. 11. To release the pawls 112 from the detent recesses 102, the surface 134 of the release actuator 108 is pressed upwardly, thereby rotating the release actuator 108 in a clockwise fashion. The release actuator 108 operates as a rocker switch about a central fulcrum 118.

When the surface 134 of the release actuator 108 is pressed upwardly, the link 130 carries the latch actuating slug 92 rearwardly against the bias of the spring 95. The movement of the latch actuating slug 92 also rotates the link 128 in a counterclockwise direction, and pulls the plug 96 from the mouth 90 of the vent line 88. This causes the bladder 80 in the chin guard 19 to immediately deflate.

As the latch actuating slug 92 moves forwardly from the position of FIG. 10 to the position of FIG. 11, the release actuator 108 is rotated clockwise about the pin 118, while the intermediate arm 114 is rotated counterclockwise about the fulcrum 116. The pawls 112 are both pulled transversely outwardly from the detent recesses 102, thereby totally releasing the tongue 98. The chin guard 19 can thereupon be fully swung open.

In closing the chin guard 19, the tip 100 of the tongue 98 engages the forward concavity of the latch actuating slug 92, as depicted in FIG. 11. As the chin guard 19 moves from right to left, as viewed in FIG. 11, the tongue 98 forces the latch actuating slug 92 rearwardly, thereby ensuring that the plug 96 is brought into sealing engagement in the vent line mouth 90 and ensuring that the links 128 and 130 are brought into nearly linear, transverse alignment, as depicted in FIG. 10. The release actuator 108 and the intermediate arm 114 are thereby respectively rotated counterclockwise and clockwise about the pins 118 and 116. The rotational movement of the arms 114 and 108 drives both of the pawls 112 transversely inwardly into the detent recesses 102, thereby firmly engaging the tongue 98 to secure the chin guard 19 shut against the casing 12.

Once the latch mechanism 110 is in the engaged position depicted in FIG. 10, the wearer can inflate the cushioning bladder 80 though the extremity 84 of the filling tube 82. The plug 96 in the mouth 90 of the vent line 88 prevents the cushioning bladder 80 from deflating until such time as the wearer choses to open the chin guard 19. To open the chin guard 19, the wearer merely presses upon the surface 134 to move the release actuator 108 from the position of FIG. 10 to the position of FIG. 11, in the manner previously described.

Undoubtedly, numerous variations and modifications of the invention will become readily apparent to those familiar with cycle helmets. Accordingly, the scope of the invention should not be construed as limited to the specific embodiment depicted and described, but rather is defined in the claims appended hereto.

I claim:

1. A protective helmet comprising a casing shaped to conform to the back, crown and sides of a human head and defining parallel arcuate tracks positioned to reside on opposite sides of the eye area of a human face, and a sliding visor having opposite edges entrapped in said tracks and reciprocally moveable in tandem therewithin, whereby said visor slides relative to said casing to selectively expose and shield the eye area of a human face therebehind.

2. A protective helmet according to claim 1 further comprising a chin guard for protecting the jaw area of a human face and said chin guard is attached to said casing by a hinge connection on one side and further comprising a latch mechanism with a release actuator on the opposite side of said chin guard and on said casing.

3. A protective helmet according to claim 2 in which said latch mechanism is comprised of a tongue projecting longitudinally from said chin guard for insertion into said casing and having a wedge shaped tip and transverse detent recess means behind said tip and said latch mechanism is further comprised of pawl means mounted for transverse reciprocal movement on said casing to move between engaged and disengaged positions relative to said detent recess means, and said release actuator is coupled to said pawl means to move said pawl means from said engaged to said disengaged position, and said tip of said tongue is engageable with said casing to move said pawl means from said disengaged to said engaged position.

4. A protective helmet according to claim 3 in which said chin guard includes an inflatable bladder which serves as a chin cushion, and said inflatable bladder has a relief vent in said casing, and said casing also has a valve closure element coupled to said pawl and to said release actuator and moveable into sealing engagement with said relief vent, whereby insertion of said tongue into said casing forces said valve closure element into sealing engagement with said relief vent and said pawl means into said engaged position in said detent recess means, and said release actuator concurrently moves said valve closure element out of sealing engagement with said relief vent when moving said pawl means to said disengaged position.

5. A protective helmet according to claim 4 further comprising a filling tube connected to said inflatable bladder and extending to the mouth area of a wearer, and a check valve between said bladder and said filling line for allowing said bladder to be inflated and preventing venting of air through said filling tube.

6. A protective helmet according to claim 2 wherein said release actuator is recessed from the surface of said chin guard and said casing.

7. A protective helmet according to claim 2 in which said hinge connection includes an internal hinge and the outer surface of said helmet is smooth at an interface between said chin guard and said casing adjacent to said internal hinge.

8. A protective helmet according to claim 2 further comprising air circulation inlet means in said chin guard and air circulation outlet means in the rear of said casing.

9. A protective helmet according to claim 1 further comprising a cam mechanism in said casing above the eye area thereof to deflect said visor outwardly away from said casing as said visor rotates relative thereto to expose the eye area of a human face therebehind, and said visor clears said cam mechanism when moved to shield the eye area of a human face and further comprising biasing means interposed between said visor and said casing to urge said visor into flush alignment with said casing when said visor is moved to shield the eye area of a human face.

10. A protective helmet according to claim 1 further comprising ear shields on opposite sides of said casing, padding within said ear shields, and audio passageways through said ear shields and through said padding.

11. In a protective cycle helmet having a hard casing which envelopes the back, crown and sides of a wearers head and which has resilient padding therewithin, the improvement comprising tracks defined within the structure of said casing, a sliding visor which is reciprocally moveable along said tracks to selectively expose and shield the eye area of a wearer, a chin guard hingedly attached to said casing on one side of the jaw area of a wearer, a latch mechanism for releasably securing said chin guard in position to extend across and protect the jaw of a wearer, and a manually actuable release actuator for disengaging said latch mechanism.

12. A cycle helmet according to claim 11 further characterized in that said latch mechanism is comprised of a tongue on said chin guard having a broad tip and a notch therebehind, and a lever mechanism on said casing including a catch moveable transversely relative to said tongue between engaged and disengaged positions relative to said notch, an intermediate arm having a first end rotatably coupled to said catch, a second end, and a fulcrum between said ends, a link rotatably connected to said second end of said intermediate arm, and a reciprocal latch actuator rotatably connected to said link and longitudinally aligned with and engageable by said tip of said tongue for moving said catch into engagement with said notch, and said release actuator is operably connected to said latch actuator to disengage said catch from said notch.

13. A cycle helmet according to claim 12 further comprising an inflatable bladder in said chin guard and a vent line terminating in a mouth located in the path of movement of said latch actuator, and said latch actuator includes a plug for sealing said vent line mouth when moved to engage said catch in said notch and to unseal said vent line mouth when moved by said release actuator to disengage said catch from said notch.

* * * * *